United States Patent [19]

Kloesel, Jr.

[11] 4,293,048

[45] Oct. 6, 1981

[54] JET DUAL BIT

[75] Inventor: Joseph A. Kloesel, Jr., Midland, Tex.

[73] Assignee: Smith International, Inc., Newport Beach, Calif.

[21] Appl. No.: 115,228

[22] Filed: Jan. 25, 1980

[51] Int. Cl.[3] ..... E21B 9/10

[52] U.S. Cl. ..... 175/340; 175/215

[58] Field of Search ..... 175/340, 215, 213, 60, 175/339, 325, 69

[56] References Cited

U.S. PATENT DOCUMENTS

| | | | |
|---|---|---|---|
| 3,329,222 | 7/1967 | Neilson | 175/340 |
| 3,416,617 | 12/1968 | Elenburg | 175/339 |
| 3,416,618 | 12/1968 | Kunnemann | 175/215 X |
| 3,419,092 | 12/1968 | Elenburg | 175/215 X |
| 3,542,144 | 11/1970 | White | 175/215 X |
| 3,596,720 | 8/1971 | Elenburg | 175/215 X |
| 3,712,392 | 1/1973 | Dela Gorgendiere | 175/215 X |
| 3,825,083 | 7/1974 | Flarity | 175/325 X |
| 3,833,077 | 9/1974 | Lavallee | 175/325 |
| 4,185,706 | 1/1980 | Baker | 175/340 |
| 4,189,014 | 2/1980 | Allen et al. | 175/339 |

FOREIGN PATENT DOCUMENTS

| | | | |
|---|---|---|---|
| 2641737 | 3/1978 | Fed. Rep. of Germany | 175/340 |
| 1477069 | 6/1977 | United Kingdom | 175/340 |
| 572561 | 9/1977 | U.S.S.R. | 175/340 |

*Primary Examiner*—James A. Leppink

*Attorney, Agent, or Firm*—Murray Robinson; Ned L. Conley; David Alan Rose

[57] ABSTRACT

Dual flow passage drilling means includes a dual flow passage sub and a dual flow passage bit. The bit has a threaded tubular pin and a flat seal shoulder there around, adapted to make a rotary shouldered connection with a central box at the lower end of the sub.

The bit includes a cylindrical body with a central flow passage and three circumferentially spaced off-axial holes centered 120 degrees apart providing outer fluid passage means communicating through the bit shoulder with the sub's annulus. Beneath the body are earth formation reducing means, including three jet nozzles connected to the off-axial holes. The earth formation reducing means further includes three drilling cones rotatably mounted on three legs depending from the body. The legs are centered 120 degrees apart, for example midway between the nozzles. The diameter of the earth bore is determined by the locus of the outermost parts of the cones as the cones rotate at the bottom of the bore. The outer surfaces of the bit legs and sub are well within the bore diameter.

A belt around the bit body above the level of the earth formation reducing means has only a rotating clearance with the earth bore, thereby to seal the bore annulus and centralize the bit tending to keep the legs and sub out of contact with the earth bore. Detritus retention means in the form of single or double webs between the nozzles and legs, or braces between the legs, may be provided.

7 Claims, 15 Drawing Figures

23
27
29
28
30
91
93
33
55
51
92
57
35
95
59
53
31
37
87
39
41
85
81
43
83
45
21
65
67
66
73
2
2
69
68
175
21
101
25
127
X
63
71
75
107
105
125
3
3
109
115
110
129
111
113
103
177
121
161
123
126
139
61
159
137
131
137
174
135

JET DUAL BIT

INDEX

Background of the Invention
(a) Single Flow Passage Drill Bit
(b) Dual Flow Passage Drill Pipe
(c) Dual Flow Passage Bits
(d) Annulus Seals
(i) Seal at Upper End of Drill String
(ii) Differential Pressure
(iii) Seal Down Hole Just Above Bit
(iv) Seal Around Bit
(1) Without Cones
(2) With Cones
(3) With Cones and Sub
(e) Subs
(f) Comparison of Dual Conduit Bits with Certain Single Conduit Bits
(i) Shrouded Single Conduit Bits
(ii) Core Bits
(iii) Caisson Bits
(g) Comparison of Bit Seals, Barriers, or Outside Skirts with Other Forms of Bit Flow Control Means
(i) Weirs
(ii) Inside Skirt
(iii) Nozzles or Tubes
(iv) Outside Skirt
(v) Examples of Flow Control Means
(h) Outside Fluid Passage Means
(i) Single Conduit Bit
(ii) Fluted bit
(iii) Hole through Shoulder
(iv) Off-Axial Holes Through Pin
(v) Holes Through Pin Shoulder
(i) Commercial Examples
(i) Shrouded Security Cross Section Core Bit
(ii) Skirted Smith Dual Flow Passage Jet Rock Bit
(iii) Grunder-Williams
(1) Early Work
(2) Williams KB-3
(3) Gruner Integral Bit
(4) Proposed Modifications
(5) Gruner G-6 Bits
(6) Gruner Bits with Elenburg Subs
(7) Gruner Air Cooled Bits
(iv) Drilco Dual Pipe
(v) Dual Subs
(vi) Skirted Standard Bits
(vii) Special Dual Flow Passage Bits
(viii) Reaming Shell and Bridge
(j) Difficulties with Dual Conduit Down Hole Drilling Apparatus
(i) Introduction
(ii) Bit with Sub
(iii) Seal Bits
(iv) Summary
Summary of the Invention
Brief Description of the Drawings
Description of Preferred Embodiments
(a) Dual Conduit Rotary Drill String
(b) Dual Drill Pipe
(c) Dual Conduit Drilling Assembly
(d) Dual Conduit Sub
(e) Dual Conduit Bit—First Embodiment
(f) Dual Conduit Bit—Further Embodiments (g) Dual Conduit Bit—Second Embodiment
(h) Dual Conduit Bit—Third Embodiment
(i) Dual Conduit Bit—Fourth Embodiment
Claims

BACKGROUND OF THE INVENTION

This application pertains to drill bits and more particularly to bits adapted for use with dual flow passage drill pipe in the rotary system of drilling, employing a drilling fluid such as air, gas, water, oil or mud to remove the detritus.

(a) Single Flow Passage Drill Bit

Conventional rock bits used with single conduit drill pipe, hereinafter sometimes called single flow passage bits because all the flow inside the bit is in a single general direction, include three legs depending from a tubular body with a toothed cone rotatably mounted on each leg. The upper end of the tubular body is threaded for making a rotary shouldered connection with the drill string member thereabove, e.g. with a drill collar in the case of deep drilling where the drill pipe is run in tension, or a stiff drill pipe for shallow holes drilled with a drill rig equipped to push down on the drill string. Usually the bit's tubular body is threaded as a pin rather than a box. Since drill pipe usually is run pin down, a dual box sub or drill collar or drill pipe is usually employed between the drill bit and the rest of the drill string.

(b) Dual Flow Passage Drill Pipe

It is known to drill earth bores using a string of dual flow passage drill pipe. Each length of drill pipe may comprise an outer tube and an inner tube with one flow passage provided by the annulus formed between the inner and outer tubes and a second flow passage provided by the inner tube. See, for example, the patents referred to in U.S. Pat. No. 4,067,596—Kellner et al.

(c) Dual Flow Passage Bits

It is known to employ a dual flow passage drill bit at the lower end of a string of such dual flow passage drill pipe. The bit has flow passage means communicating with the flow passage through the drill string provided by the inner tubes. The drill bit has other flow passge means communicating with the flow passage through the drill string formed by the annulus passages between the inner and outer tubes.

Typically, the bit flow passage means communicating with the inner tube of the lowermost length of drill pipe in the drill string is a central hole in the bit body. Usually the bit flow passage means communicating with the annulus flow passage of the lowermost length of the drill pipe comprises a plurality of holes through the bit body.

It is known to provide dual flow passage bits with rolling cutters, with drag blades, or with diamond studded downwardly facing abrading surfaces, e.g. for drilling hard formations, soft formations, or coring.

The following patents illustrate certain dual conduit and analogous bits and the like:

U.S. Pat. No. 2,894,727—Henderson
U.S. Pat. No. 3,198,267—Madson
U.S. Pat. No. 3,215,215—Kellner
U.S. Pat. No. 3,578,093—Elenburg In addition, reference may be made to many of the further patents listed and discussed hereinafter with reference to dual conduit and other forms of drilling.

(d) Annulus Seals (i) Seal at Upper End of Drill String

In early dual conduit drilling, return upflow through the dual conduit bit and drill pipe was insured by sealing the annulus at the upper end of the drill string using a drilling head or the like. In this regard compare some of the following patents:

U.S. Pat. No. 2,543,382—Schabarum
U.S. Pat. No. 3,208,539—Henderson
U.S. Pat. No. 3,795,283—Oughton Such an arrangement, however, is little better than the practice known as "split-streaming" in which loss to the annulus is merely tolerated, for with a seal at the upper end of the annulus the annulus capacity must be satisfied before fluid loss stops; also, the formation may be permeable, causing continuous lost circulation (ii) Differential Pressure Sometimes the annulus adjacent the bit is pressurized, either with a heavy fluid or with a gas under pressure, to prevent fluid flow up the annulus.

(iii) Seal Down Hole Just Above Bit

It has also been disclosed that an annulus seal may be placed down the hole just above the bit. In this connection, compare some of the following patents:

U.S. Pat. No. 2,234,454—Richter (hood 55)
U.S. Pat. No. 2,550,080—Moore (packer or cup 7)
U.S. Pat. No. 2,657,016—Grable (packer 75)
U.S. Pat. No. 2,885,184—Ortloff et al. (seal 15)
U.S. Pat. No. 3,155,179—Hunt et al. (packer seal ring or collar 38)
U.S. Pat. No. 3,283,835—Kellner (packer sealing element 28)
U.S. Pat. No. 3,417,830—Nichols (packer 70)
U.S. Pat. No. 3,503,461—Shirley (packer P)
U.S. Pat. No.3,638,742—Wallace (seal means S-1)
U.S. Pat. No. 3,655,001—Hoffman (skirt 158)
U.S. Pat. No. 3,712,392—Dela Gorgendiere (sleeve 16)

(iv) Seal Around Bit

It is also known to provide a down hole seal or barrier between the well bore and drilling means by providing the latter with a portion of full hole diameter. The full hole diameter portion tends to seal with the side of the hole being bored, thereby to cause fluid flowing out of one of the bit flow passage means to flow back up the outer bit flow passage means rather than into other places such as the space in the bore hole around the drill pipe. In this connection compare some of the following patents and other disclosures:

(1) Core Bit Type—No Roller Cutters

British Pat. No. 309,101—Rotinoff (1929)-Dredge (No Rotation)
U.S. Pat. No. 1,133,162—McAllister
U.S. Pat. No. 1,547,461—Steele
U.S. Pat. No. 2,016,785—Lawlor
U.S. Pat. No. Re. 26,669—Henderson (Seal Also at Face of Bit)
U.S. Pat. No. 3,583,502—Henderson
U.S. Pat. No. 3,807,514—Murrell (2) Dual Flow Passage Roller Cone Bit U.S. Pat. No. 3,151,690—Grable (Splined Seal Sleeve)
U.S. Pat. No. Re. 27,316—Elenburg (Orig. 3416617)
U.S. Pat. No. 3,416,618—Kunneman
U.S. Pat. No. 3,542,144—White (3) Modified Single Flow Passage Roller Cone Bit plus Special Sub U.S. Pat. No. 3,439,757—Elenburg
U.S. Pat. No. 3,596,720—Elenburg
U.S. Pat. No. 3,667,555—Elenburg ps where the full hole or seal portion rotates with the drill string, there will be a certain amount of clearance, i.e. a rotating clearance, between the well bore and the seal portion. Such a portion is therefore sometimes called a barrier rather than a seal. However, the rotating clearance is filled with detritus and drilling fluid so that it may actually seal.

(e) Subs

As mentioned above, to facilitate stabbing when making up drill string connections, the drill string components, e.g. drill pipe and drill collars, are usually run with the threaded pins lowermost. This is true of dual tube drill pipe and drill collars as well as for single conduit drill pipe and collars. On the other hand, for various reasons, e.g. to prevent wobble off, drill bits are usually provided with upstanding threaded pins rather than with threaded boxes. This holds true for dual flow passage bits as well as for single flow passage bits.

In order to connect a bit having a threaded upstanding pin with a drill collar having a threaded pin on its lower end, double box drill string member, for example a double box sub is interposed therebetween.

A sub provides an opportunity to switch from outer tube threaded connections present in the drill stem of a dual conduit drill string to an inner tube threaded connection between the dual bit and sub. Having the bit threaded on the inner flow passage between bit and sub, the outer flow passage means is connected through the tool joint shoulder, there being a plurality of passages or ports through the drill bit shoulder communicating with the dual sub annulus forming its outer flow passage means. In this connection compare the disclosure of U.S. Pat. No. 3,542,144—White (supra).

A single flow passage bit can therefore be readily modified for dual flow by a machine shop or the manufacturer. It is only necessary to cut back the bit shoulder a little in order better to receive the shoulder of the dual box sub and to bore ports through the bit body between the bit legs.

For an even simpler conversion the sub may be provided with a skirt extending down around the outer periphery of the bit body forming a flow passge exterior to the bit body. Such a construction is exemplified by U.S. Pat. No. 3,439,757—Elenburg (supra). This type of construction is believed now to be more or less standard for dual conduit drilling as currently practiced.

In connection with subs, or the like, with skirts or skirt-like configuration or wherein ports above cutters direct flow to the outside part of the hole, compare some of the following patents:

U.S. Pat. No. 597,316—Durbrow
U.S. Pat. No. 701,547—Davis
U.S. Pat. No. 1,685,045—Clarke
U.S. Pat. No. 1,721,921—Phipps et al.
U.S. Pat. No. 2,238,895—Gage
U.S. Pat. No. 2,293,259—Johnson
U.S. Pat. No. 2,419,738—Smith
U.S. Pat. No. 2,543,382—Schabarum
U.S. Pat. No. 2,562,346—Whittaker U.S. Pat. No. 2,849,214—Hall
U.S. Pat. No. 3,077,358—Costa
U.S. Pat. No. 3,102,600—Jackson
U.S. Pat. No. 3,155,177—Fly
U.S. Pat. No. 3,268,071—Yarbrough
U.S. Pat. No. 3,713,488—Elenburg (f) Comparison of Dual Conduit Bits with Certain Single Conduit Bits Dual conduit bits, i.e. bits intended for use with dual conduit drill pipe, are related both to single conduit bits intended for reverse circulation and to core bits employing local reverse circulation at the bottom of the hole, and to caisson bits, but there are certain basic differences as will be discussed in the following:

(i) Shrouded Single Conduit Bits

Single conduit bits, especially when used for reverse circulation, have been provided with webs or "shrouds" extending between the bit legs or with a skirt extending about the cutter blades to insure that drilling fluid flowing down the annulus will reach bottom before turning inwardly across the cutters to flow up the center of the bit. This is to insure that cuttings are swept up and that the cutter cones or blades are cleaned. Such "shrouded" or "skirted" bits are usually field modifications of ordinary single conduit bits, so the literature about them is not extensive.

In connection with shrouded or skirted single conduit reverse circulation bits, compare some of the following U.S. patents:

U.S. Pat. No. 1,236,981—Reed
U.S. Pat. No. 1,289,179—Hughes
U.S. Pat. No. 1,582,332—Brutus
U.S. Pat. No. 1,778,966—Stokes
U.S. Pat. No. 2,020,625—Thaheld
U.S. Pat. No. 2,261,546—Gipson
U.S. Pat. No. 2,849,214—Hall
U.S. Pat. No. 3,174,564—Morlan
U.S. Pat. No. 3,292,719—Schumacher, Jr.

It is to be noted that whether a shrouded or skirted single conduit bit is used for reverse or direct circulation, there is flow of drilling fluid past the outside of the skirt, for which reason the skirts may be called inside skirts. An inside skirt is necessarily not full gage, i.e. its outer diameter is not that of the hole being bored, since there must be room between the outer surface of the skirt and the wall of the hole for fluid to flow.

(ii) Core Bits

U.S. Pat. No. 2,698,737—Dean shows a core drill. In core bits, since the center of the bit must be open to allow passage of the core, the passages for drilling fluid are annularly disposed around the bit axis within the tubular wall forming the body of the bit. The bit thus has two passage means, one in the center for the core and the other comprising annularly disposed fluid passages for down flow of the drilling fluid. In additon, since face type cutting means, i.e., surfaces studded with diamonds or tungsten carbide or milled and hardened teeth, are used to abrade the hole bottom, the bit body has an outwardly cylindrical appearance similar to that of a shrouded bit.

However, in the conventional core bit, the drilling fluid exiting the bottom of the bit must flow across the bottom face of the bit and back up the outside of the bit body, so the body is not full hole in diameter. Also, the central passage of the drill bit is not a regular flow passage for drilling fluid; the core moves through the central passage into a blind or valve controlled core tube.

(iii) Caisson Bits

In caisson type drilling, a casing, usually having a sharpened lower edge, is lowered into a hole as the material in the center is removed, e.g. by a rotary drill. In such case the drilling fluid may flow through the central drill pipe and up or down on the inside of the casing in the annulus between the casing and pipe according to whether direct or reverse circulation is used for the rotary or other drill. The casing may extend closer to the hole than the skirt on a single conduit shrouded bit or the body of a core bit, but the casing does not rotate with the bit and is not part of the bit.

In connection with caisson type drilling, compare the disclosures of some of the following patents:

U.S. Pat. No. 146,202—Pontez
U.S. Pat. No. 1,306,674—Esseling
British Pat. No. 407,111—Rotinoff
U.S. Pat. No. 2,485,098—Johnson
U.S. Pat. No. 3,381,766—Bannister
U.S. Pat. No. 3,674,100—Becker (g) Comparison of Bit Seals, Barriers, or Outside Skirts, with Other Forms of Bit Flow Control Means In closed circulation drilling, there may be provided at the lower end of the dual conduit drill string drilling means (bit or bit plus sub) some suitable flow control means for directing the down flowing drilling fluid and receiving the spent fluid for return to the drill string and upflow to the surface. The flow control means may be provided by the dual conduit bit alone, or by the bit in combination with a sub. Such means for controlling the direction and location of flow at the bottom of the hole come in a variety of forms which may be classified as weirs, inside skirts, nozzles or tubes and outside skirts, as discussed hereinafter.

(i) Weirs

If, as is usual in closed circuit drilling, the fluid flow is down the drill string (dual flow passage drill pipe) annulus and up its inner tube and assuming like flow in the drilling means (bit) at the bottom of the hole, there may be provided an annular weir around the central flow passage of the bit to direct down flowing drilling fluid to the bottom of the hole before it is allowed to return upwardly. Such a weir is similar to an inside skirt to the extent that there is fluid flow past its outermost surface but differs therefrom in that a weir is closer to the central flow passage of the bit than an inside skirt.

(ii) Inside Skirt

Inside skirts, previously discussed in connection with shrouded, single conduit drill bits, may also be employed with the drilling means (bit) at the bottom of the hole in closed circuit (dual conduit) drilling. For example, when the down flowing fluid is directed to the outside of the cutters and it is desired that the fluid flow to the bottom rather than between the cutters before entering the central, upflow fluid passage means in the drilling mechanism, such a skirt may be employed between the down flowing fluid and the cutters.

(iii) Nozzles or Tubes

Nozzles or tubes whose inlets receive down flowing fluid may jet or positively conduct the fluid toward the cutters or between the cutters toward the bottom of the hole, after which the fluid returns up through the bit. Nozzles or tubes may be viewed as serving a function similar to weirs and inside skirts but differing therefrom in that the fluid flow is down inside the nozzles or tubes rather than down the outside thereof.

(iv) Outside Skirt

An outside skirt, that is, one which is outside the flow of drilling fluid, may be employed in the drilling means at the bottom of a closed circulation drill string, for directing fluid from the drill string annulus down around the outside the drill bit to the bottom of the hole. Such an outside skirt typically would be part of a sub to which the bit is to be connected.

(v) Examples of Flow Control Means

Various flow control means for closed circuit dual conduit bits are shown in the patents listed previously. In connection with other forms of dual conduit drilling with flow control means, compare the disclosures of the following patents:

U.S. Pat. No. 3,195,661—Jackson et al. (Nozzles and Weir)
U.S. Pat. No. 3,297,100—Crews (Tubes)
U.S. Pat. No. 3,762,486—Grovenburg (Jets and Baffles)

See also the following patents:

British Pat No. 11,902/1902—Grumbacher
German Pat. No. 334,834—Siemens (1919)
U.S. Pat. No. 1,615,921—Thompson
British Pat. No. 448,559—Schweitzer (1936)
U.S. Pat. No. 2,329,405—Mann
British Pat. No. 744,044—Coal (1952)
U.S. Pat. No. 2,701,122—Grable (1955)
French Pat. No. 1,437,230—Salzgitter (1965)
British Pat. No. 1,018,950—Hydraulic (1966)

(h) Outside Fluid Passages

One of the fluid passages in a bit employed in dual conduit drilling is almost always a central hole in the bit. This passage may be called the inner fluid passage means, and the remaining fluid passage means may be called the outer fluid passage means. Some of the patents discussed or listed above may be reclassified according to their outer fluid passage means as follows:

(i) Outer Fluid Passage Holes Do Not Enter Bit—Single Conduit Bit.

U.S. Pat. No. 1,685,045—Clarke
U.S. Pat. No. 2,234,454—Richter
U.S. Pat. No. 2,238,895—Gage
U.S. Pat. No. 2,293,259—Johnson
U.S. Pat. No. 2,419,738—Smith
U.S. Pat. No. 2,550,080—Moore
U.S. Pat. No. 2,562,346—Whittaker
U.S. Pat. No. 2,849,214—Hall
U.S. Pat. No. 3,102,600—Jackson
U.S. Pat. No. 3,198,267—Madson
U.S. Pat. No. 3,439,757—Elenburg
U.S. Pat. No. 3,503,461—Shirley
U.S. Pat. No. 3,542,144—White
U.S. Pat. No. 3,638,742—Wallace
U.S. Pat. No. 3,655,001—Hoffman (ii) Outer Fluid Passages are Slots in Exterior of Bit With Skirted Sub U.S. Pat. No. 3,596,720—Elenburg (iii) Outer Fluid Passage Holes Through Box Shoulder U.S. Pat. No. 1,547,461—Steele
U.S. Pat. No. Re. 26,669—Henderson (3308896)
U.S. Pat. No. 3,583,502—Henderson
U.S. Pat. No. 3,215,215—Killner
U.S. Pat. No. 3,151,690—Grable
U.S. Pat. No. Re. 27,316—Elenburg (3416617)
U.S. Pat. No. 3,416,618—Kunnemann
U.S. Pat. No. 3,195,661—Jackson et al
U.S. Pat. No. 2,329,405—Mann
U.S. Pat. No. 2,657,016—Grable
U.S. Pat. No. 3,807,514—Murrell (iv) Outer Fluid Passage Holes Through Pin British Pat. No. 309,101—Rotinoff (1929)
U.S. Pat. No. 1,133,162—McAllister (1915)
U.S. Pat. No. 1,721,921—Phipps
U.S. Pat. No. 2,894,727—Henderson
U.S. Pat. No. 3,208,539—Henderson
U.S. Pat. No. 3,795,283—Oughton
U.S. Pat. No. 3,283,835—Kellner (v) Outer Fluid Passage Holes Through Pin Shoulder U.S. Pat. No. 3,198,267—Madson
U.S. Pat. No. 3,542,144—White (i) Commercial Examples (i) Shrouded Security Cross Section Core Bit A paper dated May, 1959 entitled "Reverse Circulation Drilling with a Hinderliter Tool and Adapted Security Bit" by Earl Smith, described a core drilling program by Shell Oil Company employing continuous coring. Reverse circulation was employed. Reference was made to prior activity by Hostetter in which the hole was cased with drive casing to prevent loss of annulus drilling fluid. The Shell program employed instead a Hinderliter sub, just below the kelly, to provide for quick switching between direct and reverse circulation. The sub included an annular seal just above the annulus fluid port. A modified Natland core bit (Security) was employed, the modifications including removal of the core catcher and tube, enlarging the hole in the bridge, and "shrouding between the legs of the bit to direct the mud stream to the bottom of the hole." Note that in this case the mud flows down outside the shrouds.

(ii) Skirted Smith Dual Flow Passage Jet Rock Bit

H. C. Smith Oil Tool Company, predecessor of the Smith Tool division of applicant's assignee, is believed to have offered for sale, though not built, a skirted jet bit with a central return flow passage or tube for use in reverse circulation drilling employing Grable dual flow passage drill pipe. See Drawing No. 7079—H. C. Smith Oil Company entitled "7-5/8 3CF2P For Nitrogen Reverse Circulation" (4-21-57). Note that in this construction fluid flows down through tubes which are inside of skirts between the bit legs, and that the skirt extends below the tubes to about the lower extremities of the bit legs. Bits the same as shown in the drawing except without the skirts are believed to have been built, sold and used.

(iii) Gruner-Williams

Applicant's assignee, Smith International, Inc., acquired Gruner & Company, which was an offshoot of Williams Rock Bit Company, also acquired by applicant's assignee. Masson, operator of a nearby machine shop, produced bits for William and Gruner.

(1) Early Work

It is understood from interviews with Masson and Williams that they skirted rock bits as far back as 1929 and sold toothed skirted bits to Canada in about 1952–54.

(2) Williams KB3

It is understood that about 1972 Masson made some bits for Williams Rock Bit Company of Tonkawa, Oklahoma, as advertised on page 10 of that company's 1973 catalog under the title "Small Button Bit" whereat it is stated:

"The KB3 can be machined for use with dual pipe for reverse circulation."

See also drawing bearing notation N-Rod Thread which appears to show a drill string member or sub to be connected to a KB3 bit.

(3) Gruner Integral Bit

It is understood that the modified KB3 became inactive in favor of a dual bit exemplified by the accompanying photo and sketches. This bit has a one piece annular bit body which is bored out from solid bar stock to provide a central flow passage therethrough. A straight threaded tubular pin at the top of the body screws into a box at the lower end of the inner tube of a dual sub and is in communication with the flow passage through the inner tube of the sub. The outer tube of the dual sub seals on an outer shoulder lower down on the bit body than the shoulder around the pin. Off-axial holes in the body extend down from the upper shoulder to the underside of the body. The tops of the holes are in between the inner tube and outer tube of the sub to receive drilling fluid from the annulus of the sub. The lower part of the body is conically counterbored to form a downwardly flaring sleeve. The sleeve is slotted to receive bars on which roller cutter cones are mounted, the bars being welded to the sleeve. The lower ends of the holes in the body terminate in the sleeve in between the slots.

(4) Proposed Modification

As shown on the photo, it has been proposed to modify the above-described bit by omitting the off-axial holes through the body and by providing flats on the exterior of the body. In this latter regard compare the construction shown at: pages 4922, 4923 of the 1970–71 edition of the Composite Catalog of Oil Field Equipment and Services illustrating the diamond drill bits and core bits of the former Williams division of applicant's assignee.

(5) Gruner G-6 Bits

Gruner's "Granite 6" bits are advertised on pages 4 and 5 of Gruner's catalog entitled "Gruner Rock Bits". Similar bits have also been made with integral aprons or shrouds between the legs for reverse circulation. Williams also makes such bits and welds on the skirts. For Williams' bits see pages 4612, 4613 of the 1972–73 edition of the Composite Catalog of Oil Field Equipment and Services.

(6) Gruner Bits with Elenburg Subs

Gruner bits with the upper part of the body turned down to receive the skirt of an Elenburg-type skirted sub are illustrated in the accompanying drawing.

(7) Gruner Air Cooled Bits

Gruner bits with air passages in the legs to supply air to the cone bearings to cool them are shown in a U.S. patent application entitled "Air Cooled Bit" filed January of 1975 by R. D. Thomas, now abandoned.

(iv) Drilco Dual Pipe

Drilco Industrial, division of applicant's assignee, makes dual flow passage drill pipe, e.g. as shown in the accompanying copy of its house magazine "D.I. Diary" Vol. 1 No. 6 for May-June, 1975.

(v) Dual Subs

Dual flow passage subs have been furnished to Drilco Industrial. See the accompanying drawing of a dual sub.

(vi) Skirted Standard Bits

Various concerns offer three cone (jet and regular) bits. See for example:

pages 5138, 5139 and 5144 of the 1974–75 edition of the Composite Catalog of Oil Field Equipment and Services, advertising Varel bits, and pages 2744, 2745 and 2746 of the 1974–75 edition of the Composite Catalog of Oil Field Equipment and Services illustrating Hughes bits, and pages 1704, 1705 of the same catalog, advertising Dresser-Security bits.

It is understood that at various times, either in this country or in Canada, such bits have had shrouds or skirts added between the bit legs.

(vii) Special Dual Flow Passage Bits

Dual flow passage bits and related equipment are offered for sale by

Walker-Neer at pages 5215–5218 of the 1974–75 edition of the Composite Catalog of Oil Field Equipment and Services and by Dresser OME (Security) at page 1675 of the 1970–71 edition of the same catalog.

Note also Security's regular bit shown at page 1663 thereof. The Walker-Neer and Dresser dual bits may be compared with the core and drilling bits offered by Christiansen Diamond Products Company at pages 1262–1265 of the 1952 edition of the Composite Catalog of Oil Field Equipment and Services.

(viii) Reaming Shell and Bridge

A Walker-Neer brochure designated Service 2183 refers to a variety of dual flow passage equipment including a dual swivel, dual pipe, box-type rock bits, coring bits, and a reaming shell and bridge.

(j) Difficulties With Dual Conduit Down Hole Drilling Assemblies (i) Introduction It has already been pointed out that absent a down hole annulus seal, much fluid may be lost filling the annulus and flowing into the formation. A down hole seal just above the bit but separate therefrom has the disadvantage of consitituting an additional piece of equipment to be purchased, installed, and replaced. Full hole bits in which the bit body is close to full gage at cutter level are apt to get stuck in the hole.

(ii) Bit with Sub

Since single flow passage roller cone bits are easily modified for reverse circulation by welding plates between the bit legs, as shown, for example, in the above-listed article by Earl Smith (1950), the commonly used arrangement for dual flow drilling is the addition of a skirted dual sub, to such a shrouded single flow passage bit, the skirt on the sub performing the dual functions of:

(1) cooperating with the outer surface of the bit legs and shroud to form an outer flow passage, and (2) cooperating with the inner periphery of the earth bore to seal the annulus between earth bore and drill string.

Such a combination has two problems:

(a) the skirt makes a very close fit with the earth bore and may wear out as fast or faster than the bit.

(b) the skirt, extending close to the bottom of the hole and being of nearly full bore diameter, is apt to get stuck in the hole, the bottom of the hole being only partially completed and containing detritus.

Some bit and subassemblies using short shirts, e.g. as shown in the above-listed Gruner-Williams patent application, fail to get the drilling fluid to the bottom of the hole as fast as desirable.

(iii) Seal Bits

It has long been known that a complete dual bit could be provided, not requiring the use of a skirted sub. See, for example, the above-listed Steel patent of 1925 showing a bit employing fixed blades, and the aforelisted Smith Tool Company Drwg. No. 7079 of 1957. It will be noted that in both of these constructions, the bit is near full gage near the bottom of the bit, so that it may be expected that such bits will become stuck in the hole.

One can speculate that the reason fixed blade dual bits, such as that of Steele, carried the full gage diameter close to the hole bottom, was a desire to give bottom support to the outermost portions of the fixed blades, coupled with lack of appreciation of the likelihood of a bit so constructed getting stuck in the hole.

As for roller cutter construction, such as shown in the Smith Tool Company drawing, one can speculate that the provision of shrouds between the bit legs was in the tradition of modifying ordinary single flow passage bits for reverse circulation at the customer's request and at minimum expense, and the full gage part of the shrouds had to be close to the bottom of the bit where the bit leg was of largest diameter (to give maximum support for the roller cones), upper parts of the bit leg extending radially to a lesser distance.

For whatever the reason, it appears that the tradition of carrying the seal down close to the bottom of the hole adjacent to the bottom elements of the roller cones was continued in later designs, as exemplified by the above-listed U.S. patents:

U.S. Pat. No. Re. 27,316—Elenburg

U.S. Pat. No. Re. 3,416,617—Elenburg

U.S. Pat. No. Re. 3,416,618—Kunneman

U.S. Pat. No. Re. 3,542,144—White

It is expected that such bits will frequently become stuck in the hole because the full gage seal portion extends into the semi-finished, detritus-laden bottom of the hole.

(iv) Summary

It is perhaps due to the vagaries of their history of development or perhaps for other reasons or no reason at all, that most workers in the field of dual circulation bits have thought it to be desirable to locate the annulus seal or barrier as near as possible to the lower end of the bit. This is true whether the barrier is located on the bit itself or on the sub used for connecting the bit to the lower end of the drill stem. See, for example, U.S. Pat. No. 3,416,617 (bit) and U.S. Pat. No. 3,439,757 (sub) to Wayland Elenburg (supra). But bits with seals at the bottom of the hole often become stuck in the hole.

Drilling means including skirted subs, especially seal skirted subs, are expensive and wear out rapidly, as compared to ordinary subs.

It is an object of the present invention to overcome the difficulties present in known types of bottom hole drilling means.

SUMMARY OF THE INVENTION

According to the invention there is provided bottom hole drilling means comprising a dual conduit roller cone bit including an annular body, providing a central flow passage through the bit body and pin for upflow of cuttings (or core), and peripheral flow passage means in the form of off-axial flow passages extending down through the bit body connecting to tubes or nozzles extending down below the body between the bit legs to a level close to the bit bottom, and a barrier or seal belt about the body of the bit at a level above the cones. The bottom hole drilling means further includes a dual conduit sub, of smaller outer diameter than the barrier belt, and having an inner threaded box to screw onto the bit pin, and an outer shoulder to abut and seal with the bit shoulder whereby fluid in the sub's annulus will be communicated to the upper ends of ports in the bit body that communicate with the off-axial passages therethrough. The upper end of the sub has an outer threaded box and an inner telescopic pin for making connection with correlative dual conduit drill pipe.

The construction of the invention thus eliminates all skirts, shrouds, weirs, seals and barriers from the sub, so that the sub does not wear out any faster than the dual pipe and is of inexpensive construction. The barrier belt on the bit body is above the level of the bit cones so that it is less likely to become stuck in the hole. The belt acts as a centralizer, tending to keep the bit legs out of contact with the earth bore, thereby reducing wear on the bit legs. The barrier belt, being on the bit, is replaced whenever the bit cones wear out, necessitating bit replacement. No weirs, skirts, or shrouds are required for the bit, although detritus retention webs between the bit legs are employed in certain embodiments of the invention. Such webs are not skirts, shrouds or weirs as hereinabove discussed, since they do not serve as primary fluid flow directors. Rather they are detritus retainers to prevent same from rising into the annulus to cause wear on the barrier belt or to get jammed between the belt and well bore and cause the bit to get stuck in the hole. They will not cause the bit to get stuck in the hole becuase they are positioned radially inward of the earth bore.

BRIEF DESCRIPTION OF THE DRAWINGS

For a detailed description of preferred embodiments of the invention, reference will now be made to the accompanying drawings wherein:

FIG. 2 is to a larger scale than FIG. 1, the same larger scale being also employed in the other figures of the drawings;

Figure 1:
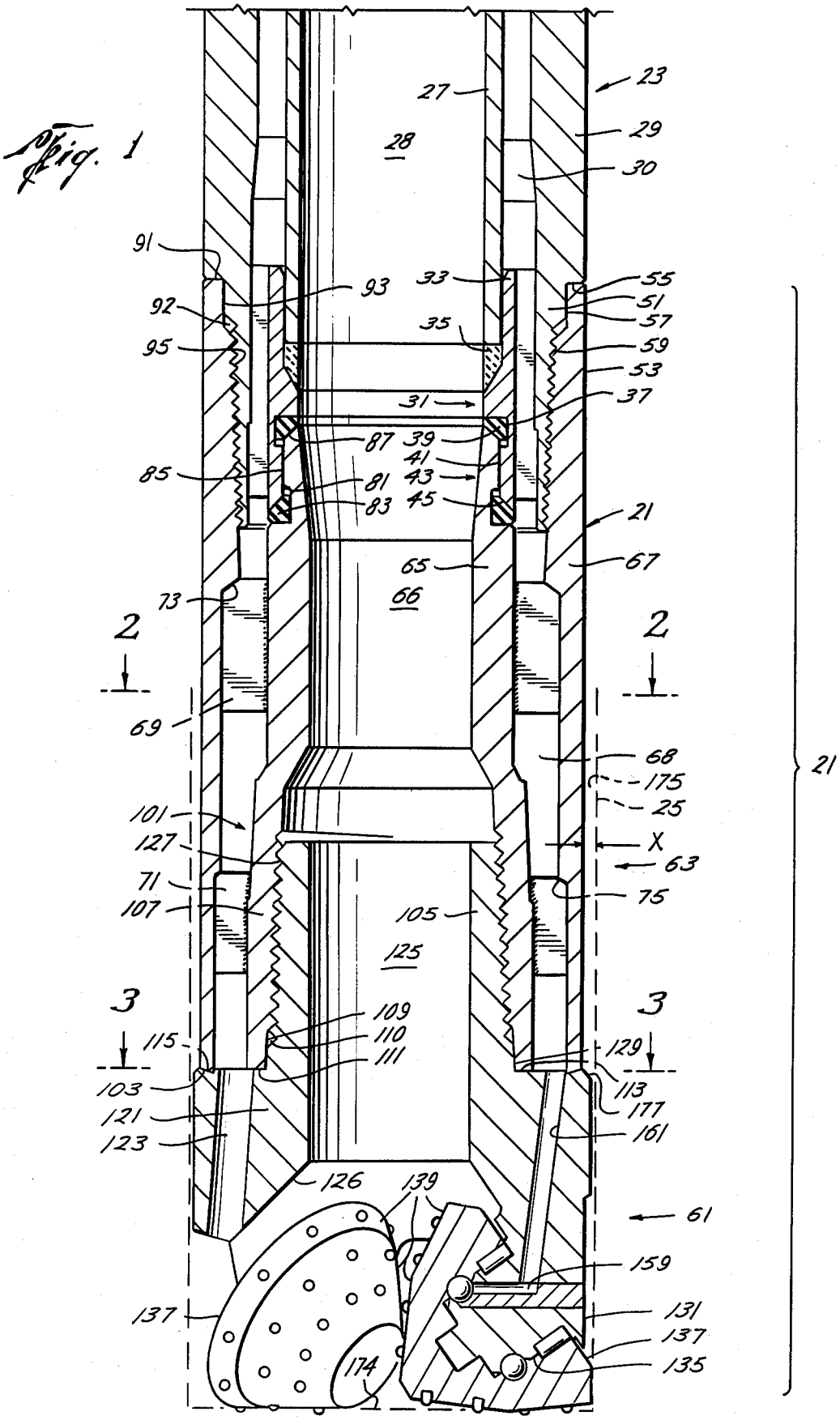
FIG. 1 is a vertical section through bottom hole drilling means embodying the invention, including a belted dual conduit drill bit and a dual conduit double box sub connected there above, the sub being connected to the lower end of a dual conduit drill collar or drill pipe.

The drawings are to scale. The drawings employ the conventions of the U.S. Patent and Trademark Office for patent cases to indicate materials, from which it will be seen that the entire construction depicted in the drawings is made of metal, e.g. steel, except for the tungsten carbide or other hard metal inserts on the bit cones, and except for the O ring seals at the upper end of the sub.

DESCRIPTION OF PREFERRED EMBODIMENTS

(a) Dual Conduit Rotary Drill String

Referring now to FIG. 1, there is shown a dual conduit bottom hole drilling assembly 21 incorporating the invention. The assembly is to be used in earth boring by the rotary method, e.g. as described in the aforementioned Grable patents.

(b) Dual Drill Pipe

The assembly is connected to the lower end of the lowermost dual pipe 23 of a string of dual conduit drill pipe. Such lowermost dual pipe may be a dual drill collar, i.e. it may be a thick-walled member which has enough stiffness that it can be run in compression and which may have enough weight to load the bit, for which reasons it will usually be of large outer diameter; nevertheless it will have a considerably smaller outer diameter than the earth bore 25 formed by drilling apparatus 21.

Dual pipe 23 includes an inner pipe 27 providing an inner flow passage 28 and an outer pipe 29 forming with the inner pipe an outer annular flow passage 30. The entire construction of dual pipe 23 may be as disclosed in U.S. Pat. Nos.

3,998,479— Bishop 4,012,061— Olson to which reference is made for further details. The dual pipe includes connection means at each end for making connection with other drill string members. Such connection means at the lower end of the pipe includes a box telescopic connector 31 having a cuff 33 at its upper end slipped over the lower end of inner pipe 27 and welded thereto at 35. The lower end of connector 31 has an internal groove 37 within which is disposed a seal ring 39 made of elastomeric or other suitable packing material, e.g. rubber. Below groove 37 connector 31 has a smooth bore 41, large enough to receive telescopically a correlative portion of a pin telescopic connector 43 at the upper end of the drilling assembly. Connector 31 has a downwardly flaring internally beveled tip 45. The lower end of outer tube 29 is provided with a pin threaded connector 51 of the tool joint type, i.e. adapted to make a rotary shouldered connection with a correlative box threaded connector 53 at the upper end of drilling assembly 21. In this regard it will be noted that pin threaded connector 51 includes a smooth, flat seal shoulder 55 perpendicular to the axis of the sub, an unthreaded smooth conical neck 57, and a tapered, externally threaded spigot 59. Suitable means, not shown, support inner pipe 27 axially and radially and circumferentially relative to outer pipe 29, as disclosed in the aforementioned Bishop and Olsen patents.

(c) Dual Conduit Drilling Assembly

Drilling assembly 21 includes dual conduit drill bit 61 and dual conduit sub 63.

(d) Dual Conduit Sub

Dual conduit sub 63 includes an inner tube 65 providing an axial flow passage 66 communicating with passage 28 and an outer tube 67 which, in cooperating with inner tube 65, provides an annular flow passage 68 communicating with passage 30. Outer tube 67 will have the same outer diameter as dual pipe 23 if, as shown, dual pipe 23 is a drill collar. In other words, there will be a considerable radial clearance x between earth bore 25 and the outer periphery of outer tube 67.

Four upper radial webs 69 and four lower radial webs 71 at circumferentially spaced apart locations about the axis of the sub (see also FIG. 2) are welded to the inner tube by axial and/or circumferential welds and the outer tube is shrink-fitted onto the webs. Also, the upper ends of the webs bear against downwardly facing annular shoulders 73, and/or 75 on the interior of the outer tube to transmit downward (compressive) forces on the outer tube to the inner tube.

The upper end of sub 63 is provided with connection means 43, 53 correlative to connection means 31, 51 on the lower end of the dual pipe. The connection means, not shown, at the upper end of dual pipe 23 will be the same as connection means 43, 53 at the upper end of sub 63.

Connection means 43, 53 includes pin telescopic connector 43 and box threaded connector 53. Pin connector 43 includes an annular groove 81 in which is disposed seal ring 83. Seal ring 83 is made of an elastomer or other suitable packing material, e.g. rubber, similar to seal ring 39, and is positioned to be compressed by tip 45. Above groove 81, connector 43 is provided with a smooth cylindrical portion 85 of a diameter adapted to fit telescopically within smooth cylindrical portion 41 of connector 31. The upper end of connector 43 has a downwardly flaring beveled tip 87 adapted to compress seal ring 39.

Box threaded connector 53 on the upper end of outer tube 67 is of the tool joint type, i.e. adapted to make a rotary shouldered connection with pin threaded connector 51 at the lower end of the dual pipe. In this regard it will be noted that box threaded connector 53 includes a smooth, flat seal shoulder or end face 91 perpendicular to the axis of the sub adapted to seal with seal shoulder 55, an unthreaded smooth cylindrical mouth 93 adapted to fit over neck 57, and a tapered, internally threaded bell 95 adapted to mate with spigot 59. Space 92 enables bell 95 to be made up with spigot 59 sufficiently to put box mouth 93 in compression and pin neck 57 in tension.

The lower end of sub 63 is provided with connection means for making connection with dual bit 61, such connection means including a box threaded connector 101 and a butt joint portion 103. Box threaded connector 101 is of the tool joint type, i.e. adapted to make a rotary shouldered connection with correlative pin threaded connector 105 on dual bit 61. Box threaded connector 101 includes tapered, internally threaded bell 107, smooth conically tapered mouth portion 109, and a smooth flat seal shoulder or end face 111 perpendicular to the axis of the sub. Butt joint portion 103 is merely the smooth, inwardly tapered shoulder or end face at the lower end of outer tube 67 adapted to seal with the smooth, matingly inwardly tapered shoulder 115 on dual bit 61, both shoulder 115 and butt joint portion 103 being inwardly tapered to prevent the flaring of the lower end of the sub. Obviously, other types of sealing means can be provided between shoulder 115 and butt joint portion 103. Space 110 functions like space 92.

(e) Dual Conduit Bit—First Embodiment

Figure 2:
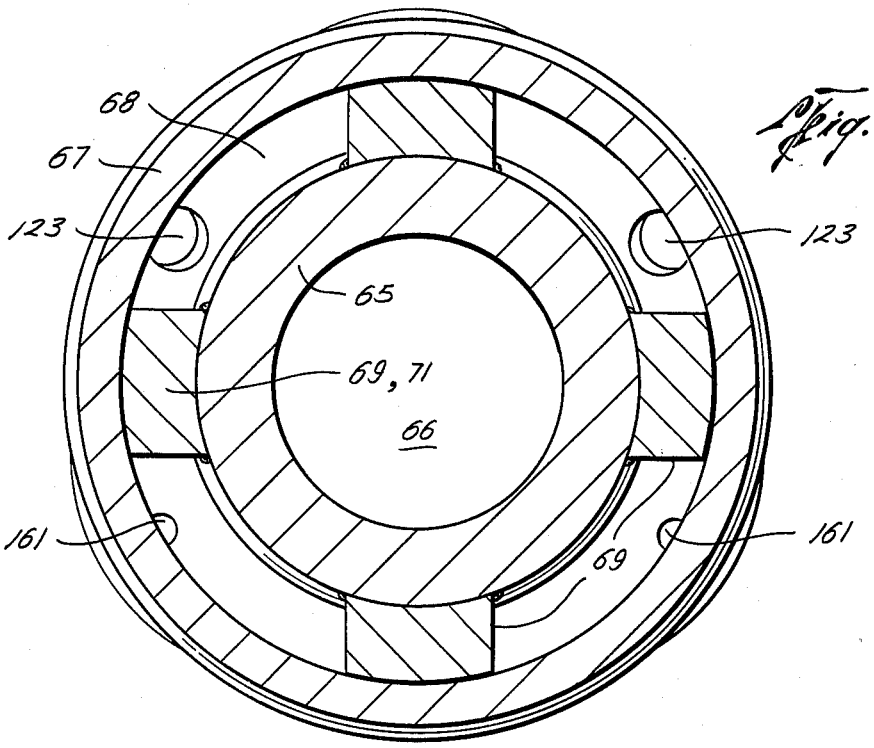
FIG. 2 is a section taken at plane 2—2 of FIG 1; however
Figure 3:
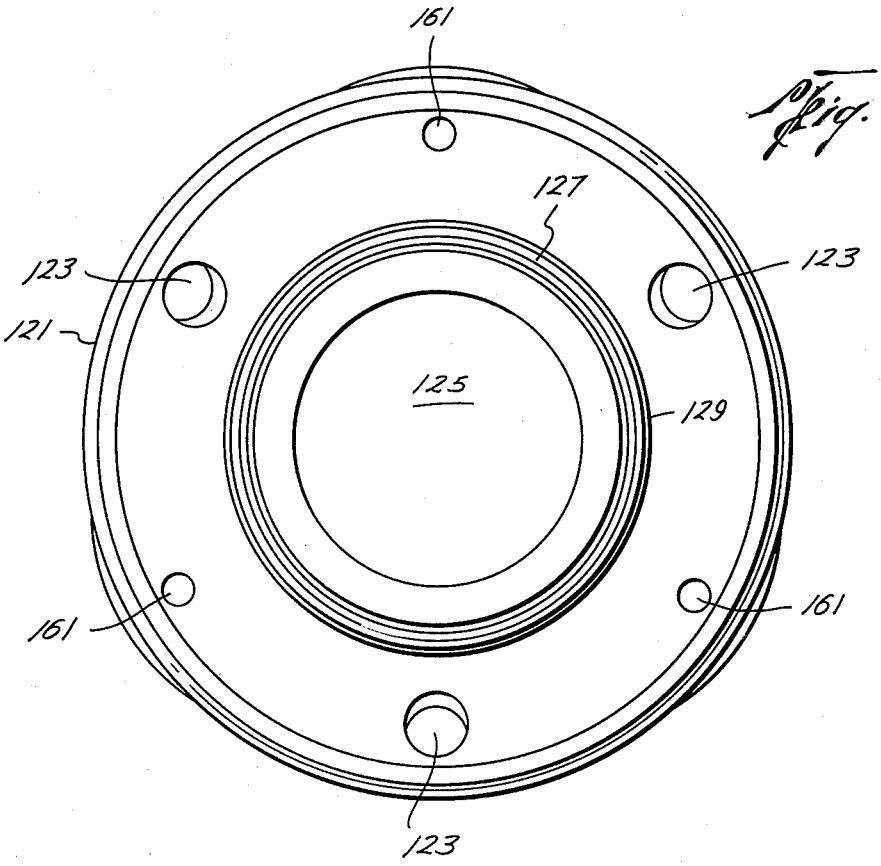
FIG. 3 is a section taken at plane 3—3 of FIG. 1, being a top view of the bit shown in FIG. 4.
Figure 4:
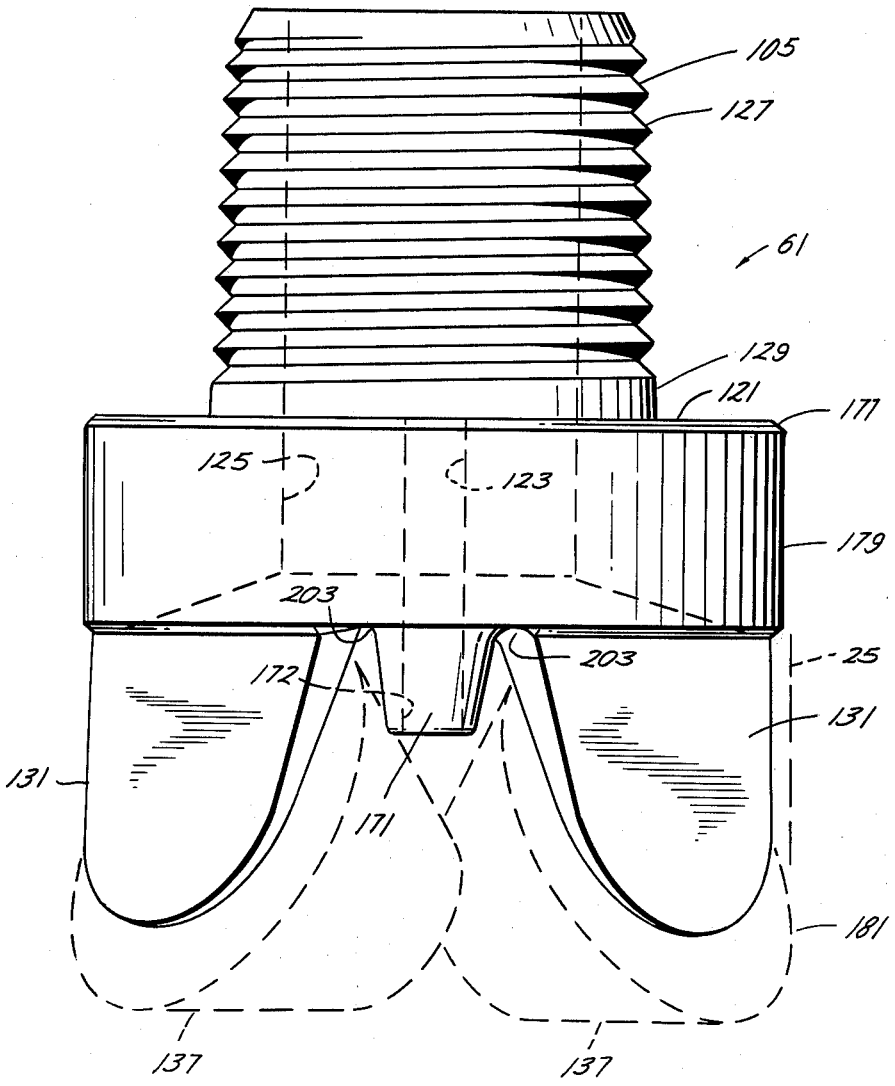
FIG. 4 is an elevation of the bit shown in FIG. 1.
Figure 5:
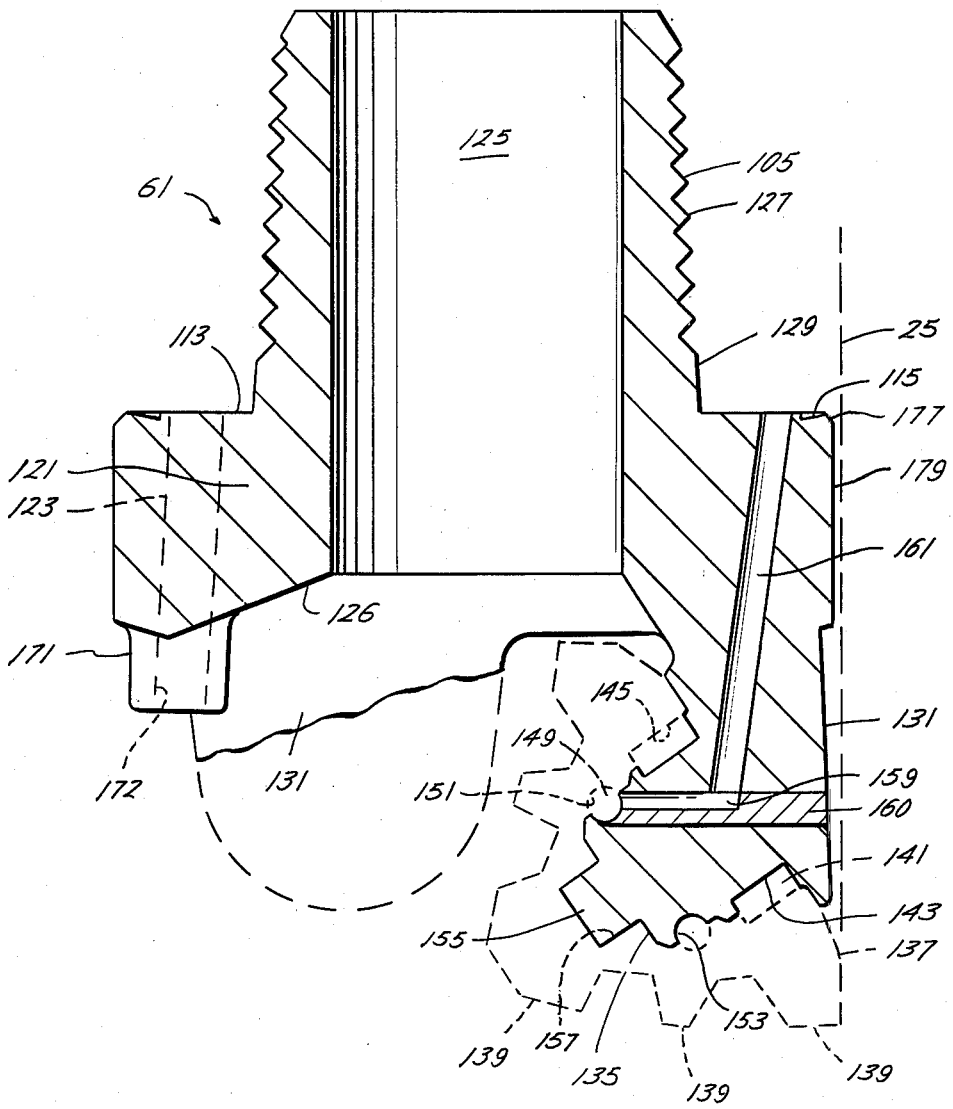
FIG. 5 is a vertical section through the bit shown in FIG. 4, taken on plane 5—5 of FIG. 6.

Referring now also to FIGS. 3, 4, 5 and 6, as well as FIG. 1, dual bit 61 includes annular body 121 through which extend three flow passages 123 equally, circumferentially spaced apart by 120 degrees, providing outer flow passage means. Internally, body 121 provides a cylindrical inner flow passage 125. As best shown in FIG. 5, the lower end of passage 125 is provided with a downwardly flaring or funnel-shaped mouth 126. Rising above body 121 and coaxial therewith is tubular pin threaded connector 105 providing a continuation of flow passage 125. Passage 125 communicates with passage 66 in the sub and through passage 68 with passage 28 in the drill collar. Connector 105 is of the tool joint type to form a rotary shouldered connection with box connector 107 at the lower end of sub 63. Connector 105 includes tapered, externally threaded spigot 127 adapted to make up with bell 107, a smooth, conically tapered neck 129 adapted to fit within smooth tapered mouth portion 109, and smooth, flat seal shoulder 113 adapted to seal with shoulder 111 and form a rotary shouldered connection. Neck 129 is in tension and mouth 109 is in compression when the connectors are fully made up, and outer fluid passage means 123 of the bit is placed in communication with annular flow passage 68 of the sub. As best shown in FIG. 2, since there are four webs 71 and only three passages 123, at least two of passages 123 will be out of alignment with webs 71, and as best shown in FIG. 1, since webs 71 are spaced vertically from the lower end of the sub, the tops of all three passages 123 in the bit are in full communication with annular passage 68 in the sub.

Figure 6:
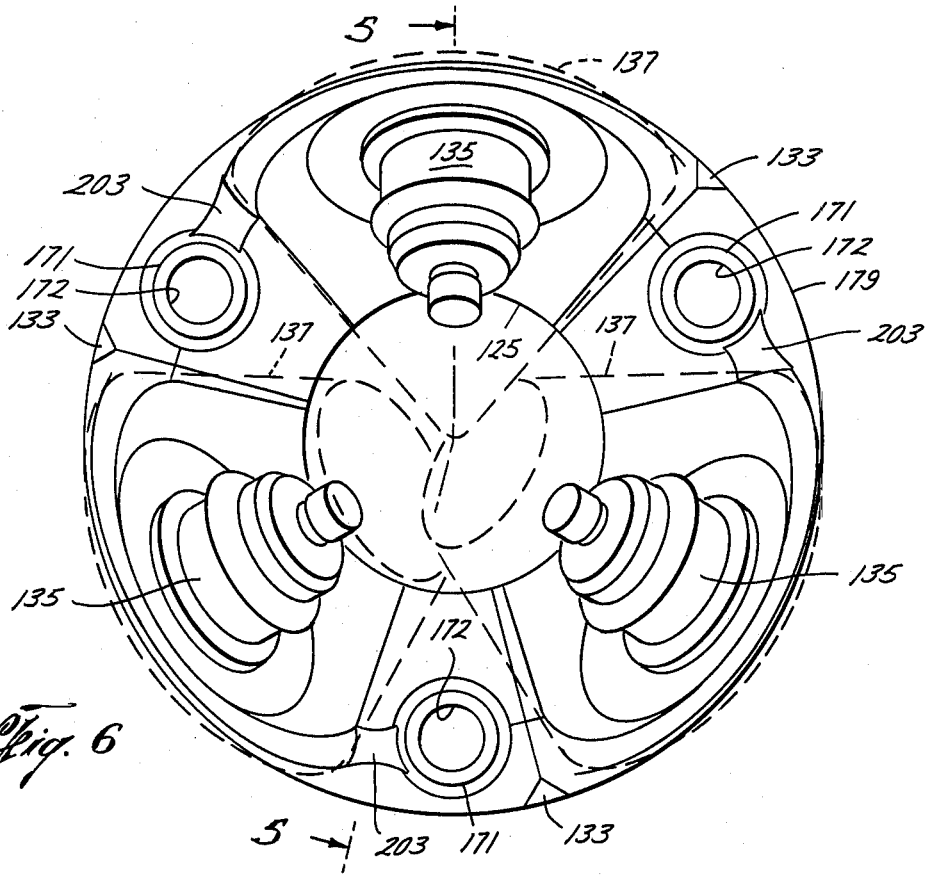
FIG. 6 is a bottom view of the bit shown in FIG. 4.

Depending from body 121 are three legs 131. The vertical center planes of legs 131 are equally circumferentially spaced apart by 120 degrees and are located midway between pasages 123. Preferably body 121 is made in three sectors, each with a leg 131 integral therewith and depending therefrom and each with a sector of connector 105 integral therewith and rising therefrom, the three sectors being welded together at 133, as shown in FIG. 6.

Integral with each bit leg is a stepped spindle 135. On each spindle is rotatably mounted a roller cone 137, each cone carrying a plurality of rings 139 (FIG. 1) of earth formation reducing means, e.g. protuberant tungsten carbide inserts or milled cutter teeth, all of conventional design, as illustrated for example in the aforementioned Gruner-Williams catalog. The axis of each cone points inwardly downwardly whereby the bottom edges of the cones as the cones roll in the bottom of a well bore define a surface that is nearly flat, being in a range between conical pointing up and conical pointing down.

Referring to FIG. 5, each of the cones 137 has a stepped interior correlative to the stepped exterior of its spindle and each is rotatably mounted on its spindle by suitable bearing means, typically roller bearings 141, such as shown, for example, at pages 5148–5149 of the 1976–77 Composite Catalog of Oil Field Equipment and Services. The rollers are placed in a race 143 extending around the largest diameter step of each spindle or in a correlative race 145 in the cone. Each cone is then placed on the spindle, and locked in place by ball bearings 149 placed in the space between annular grooves 151, 153 extending around the interior of each cone and the intermediate step on the exterior of each spindle. The balls may be put into position through a hole in the cone or leg (not shown) which is later closed with a screw plug or weld metal. Additional rotation support for each cone is provided by the cylindrical tip 155 received in socket 157 in the cone, forming a journal bearing.

In order to cool the bearing means for each cone (the journal bearing, ball bearings, and roller bearings), drilling fluid (typically air, gas, oil, water or even mud) is admitted to the bearing means by fluid passage means comprising a horizontal passage 159 in the leg extending radially outwardly from ball groove 153 to join with a sloping vertical passage 161. The outer end of each passage 159 is closed with a drive pin 160 or screw plug or weld metal. The top end of each passage 161 opens to shoulder 115 to communicate with flow passage 68 between inner tube 65 and outer tube 67 of sub 63, which in turn communicates with passage 30 between inner pipe 27 and outer pipe 29. As best shown in FIG. 2, the center lines of flow passages 161 are equally circumferentially spaced apart by 120 degrees and are disposed midway between flow passages 123.

During drilling air or other drilling fluid flows down passages 30 and 68 into passage 161 and thence into passage 161 to cool the bearing means, the air flowing past the bearing means and then out between the cones and spindles to return back through passages 125, 66 and 28.

At the lower side of body 121, in between legs 131 are three nozzles 171 (see especially FIG. 6). These nozzles connect to the lower ends of fluid passages 123 in bit body 121 and are formed integral therewith or are removably replaceably secured thereto by any suitable means, e.g. screw threads, as shown, for example, at page 4578 of the 1974–75 edition of the Composite Catalogs of Oil Field Equipment and Services. As shown, the bodies of nozzles 171 are forged integral with bit bodies 121 and thereafter machined to provide bores 172 and other finished dimensions. Nozzles 171 extend far enough below body 121 to open at a level well below the horizontal plane through the top edges of cones 137 and normally somewhat above hole bottom 174. Typically the nozzles will open at a level within about the mid third of the distance between the horizontal planes of the bottommost and topmost portions of cones 137, contrary to at least some more conventional jet bits such as those shown at page 4223 of the 1974–75 edition of the Composite Catalog of Oil Field Services and Equipment, in which the nozzles open near the plane of the topmost portions of the cones. In the present example, nozzles 171 extend to the level of the horizontal plane though the uppermost rollers 141 supporting the cones on the spindles. A lower limit of the typical range would be the horizontal plane through the lowermost rollers 141. As appears from the drawing, which as noted previously is to scale, the horizontal planes through the uppermost and lowermost rollers 141 bracket the mid three-fifths of the distance between horizontal planes through the bottommost and topmost portions of cones 137.

During drilling, air or other drilling fluid flows down passages 30 in the drill pipe (and drill collars) into sub passage 68 and thence into bit body passages 123 and out through nozzles 171. Drilling fluid emerging from nozzles 171 helps cones 137 reduce earth formation at the bottom 174 of earth bore 25, flows over the outer surfaces of the cones to cool and clean them and then flows back up through inner flow passage 125, sub passage 66 and pipe passages 28.

To prevent loss of drilling fluid to bore annulus 175 (FIG. 1) bit body 121 is provided on its outer periphery with a belt 177, as best shown in FIG. 4. The belt has an outer periphery 179 whose diameter is smaller than bore 25 by an amount which may be called a rotating clearance, i.e. enough clearance to allow rotation of the bit in the bore without excessive frictional torque and wear and with little likelihood of the bit becoming stuck in the bore, especially when not rotating, yet large enough to form a seal or barrier to the flow of drilling fluid (e.g. air, gas, water, oil or mud) when the clearance is bridged by detritus and formation fluid. For example, belt 177 may have a clearance of 150 -inch radially all around within bore 25.

Since belt 177 is wholly on body 121, it is above legs 131 and well above the horizontal plane defined by the uppermost portions of cones 137 (FIG. 4). It is therefore positioned to minimize the possibility of detritus thrown up by the cones getting in between the belt and earth bore and causing the bit to become stuck in the hole. Also, the belt is in the fully formed portion of the earth bore where it is of full diameter. Further, the belt is out of the detritus zone in which the earth formation reducing means provided by the nozzles and on the cones is churning the detritus prior to its being carried away by the drilling fluid flowing up fluid passage 125, so there is less wear on the belt. At the same time the belt serves as a centralizer and keeps legs 131 away from the side bore 25, thereby reducing wear on the legs.

Cones 137 extend radially from the axis of the bit slightly beyond legs 131 to cut the full gage of bore 25. Although FIG. 4 shows the cones with nearly zero, or zero offset (cone axes intersect the bit axis) as is typical for hard formations, the cones may have offset, especially for soft formations, in which case, as shown in FIG. 4, the cones cut to full gage only at a level 181 somewhat above bottom. This is another reason why it is desirable to place belt 177 above cones 137.

(f) Dual Conduit—Further Embodiments

Referring now to FIGS. 7–9, 10–12, and 13–15, there are shown second, third and fourth embodiments of the bit previously described. Parts that are the same as in the first embodiment are given the same numbers.

(g) Dual Conduit Bit—Second Embodiment

The only difference between the first and second embodiments is the addition to the second embodiment of webs 201 between the trailing side of each nozzle and the leading side of the adjacent bit leg. In this connection it is assumed that the bit is to be rotated in the usual manner, i.e. clockwise, or to the right, as viewed from the top. Webs 201 are not to be confused with forging fillets 203 at the junctures of nozzles 171 and legs 131 in the first embodiment.

Webs 201 provide means to help retain detritus at the interior of the bit, especially that created by nozzles 171.

Webs 201 extend vertically down to the same level as the lower ends of nozzles 171; greater or lesser downward extension of webs 201, while possible, would not be as desirable, since lesser extension would provide less retention and greater extension would interfere with the flow of drilling fluid from the nozzles, which are assumed to extend to the optimum downward position for jetting of the drilling fluid to the bottom of the hole.

Figure 7:
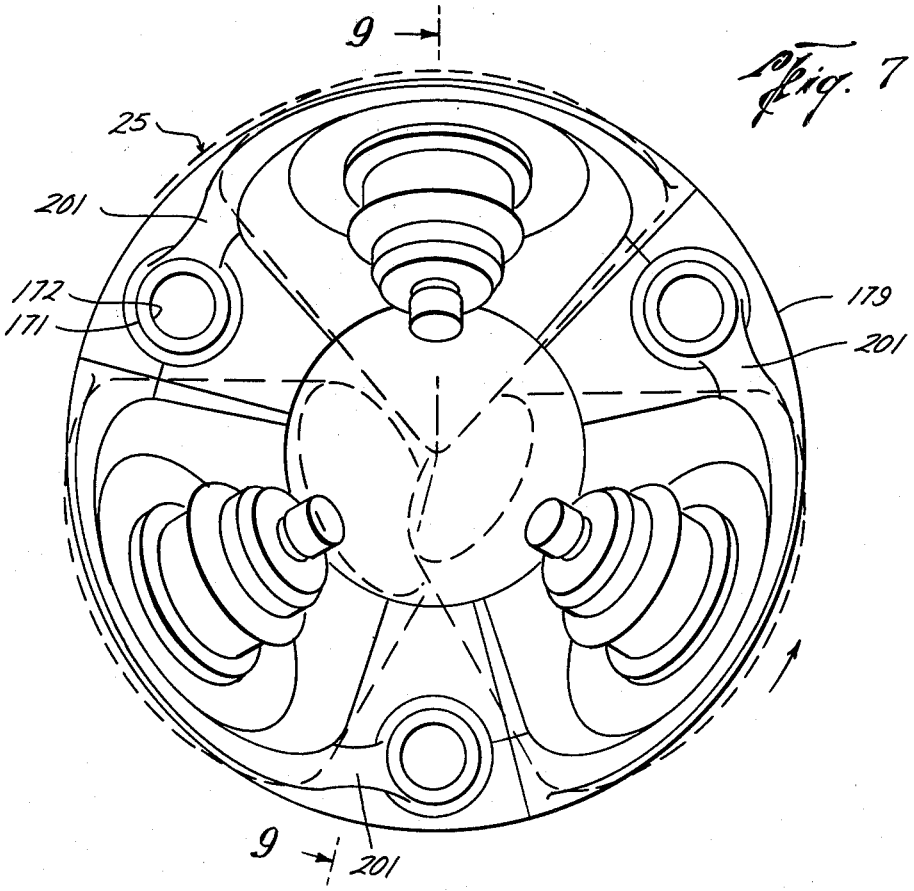
FIG. 7 is a bottom view of a modified bit employing half webs.
Figure 8:
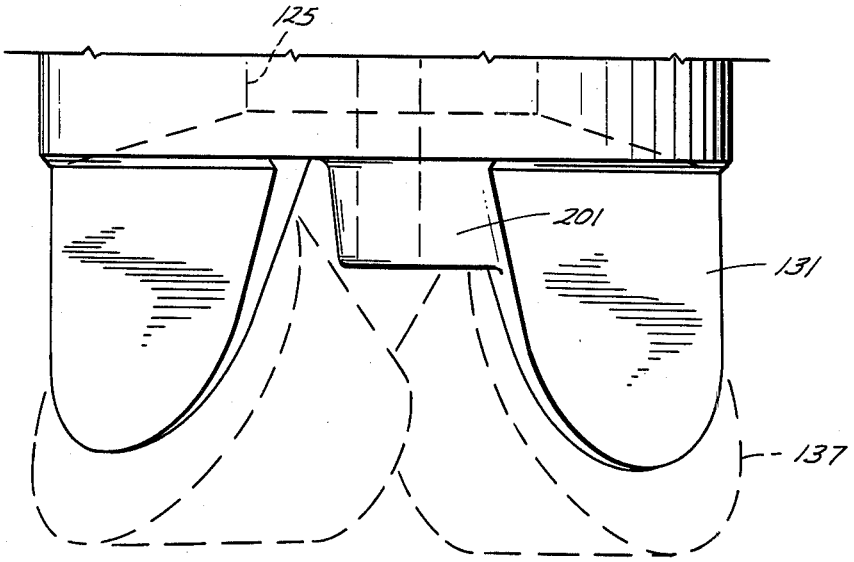
FIG. 8 is a fragmentary elevation of the bit shown in FIG. 7.
Figure 9:
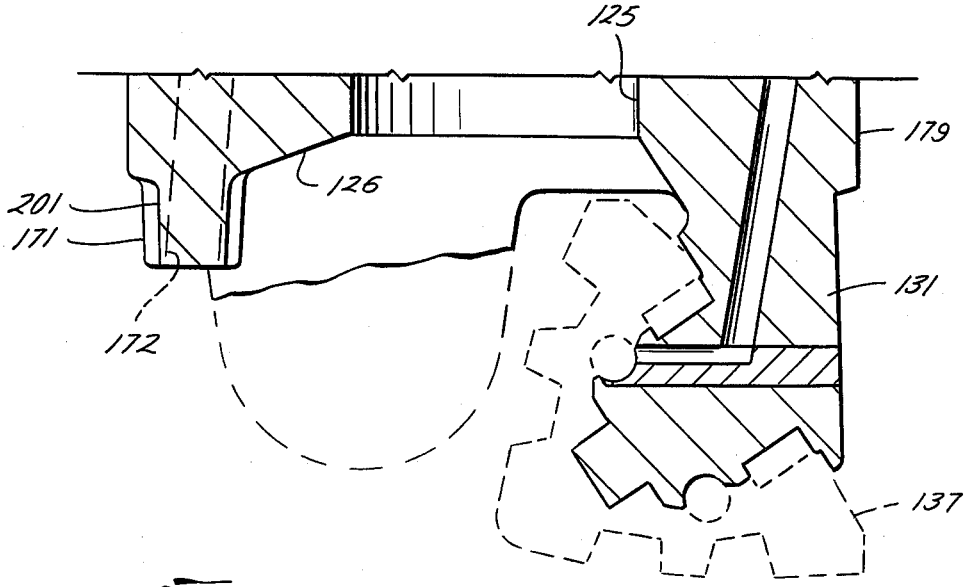
FIG. 9 is a fragmentary sectional view of the bit shown in FIG. 8, taken at plane 9—9 of FIG. 7.

As best shown in FIG. 7, webs 201 are radially inward of earth bore 25, so that there is little wear on the outer peripheries of the webs.

(h) Dual Conduit Bit—Third Embodiment

Figure 10:
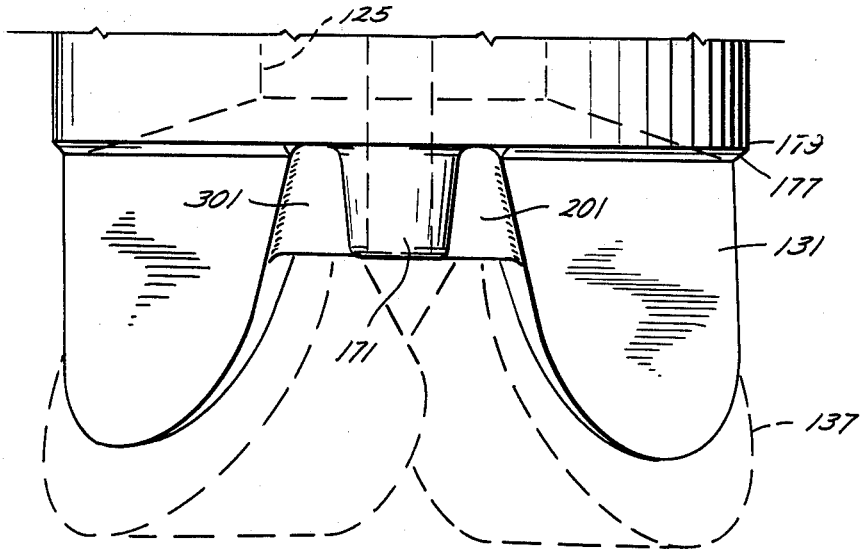
FIG. 10 is a fragmentary elevation of a further modified form of the bit, employing full webs.
Figure 11:
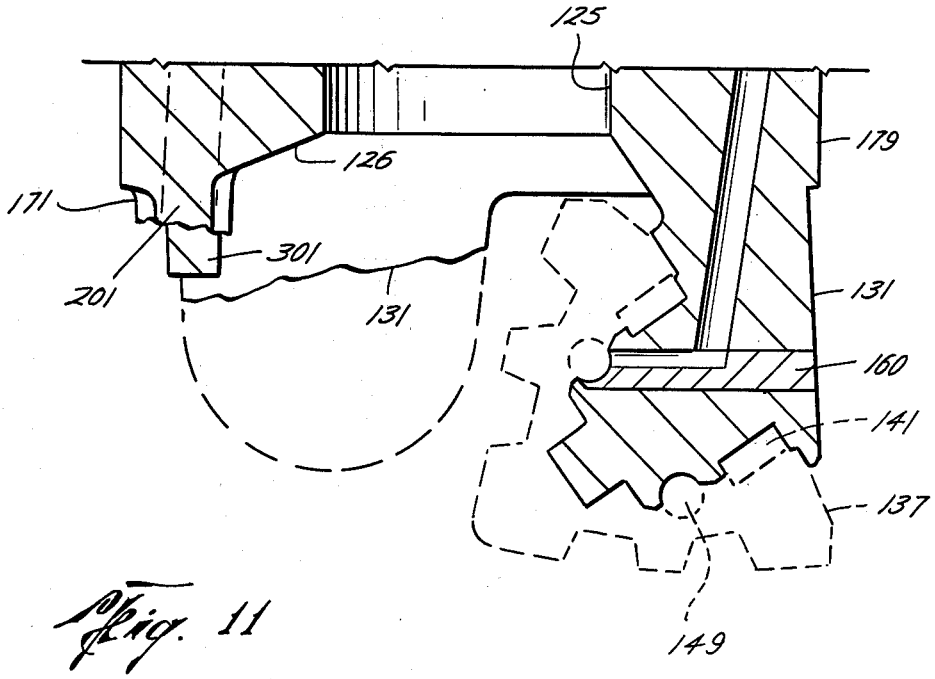
FIG. 11 is a fragmentary sectional view of the bit shown in FIG. 10, taken at plane 11—11 of FIG. 12.
Figure 12:
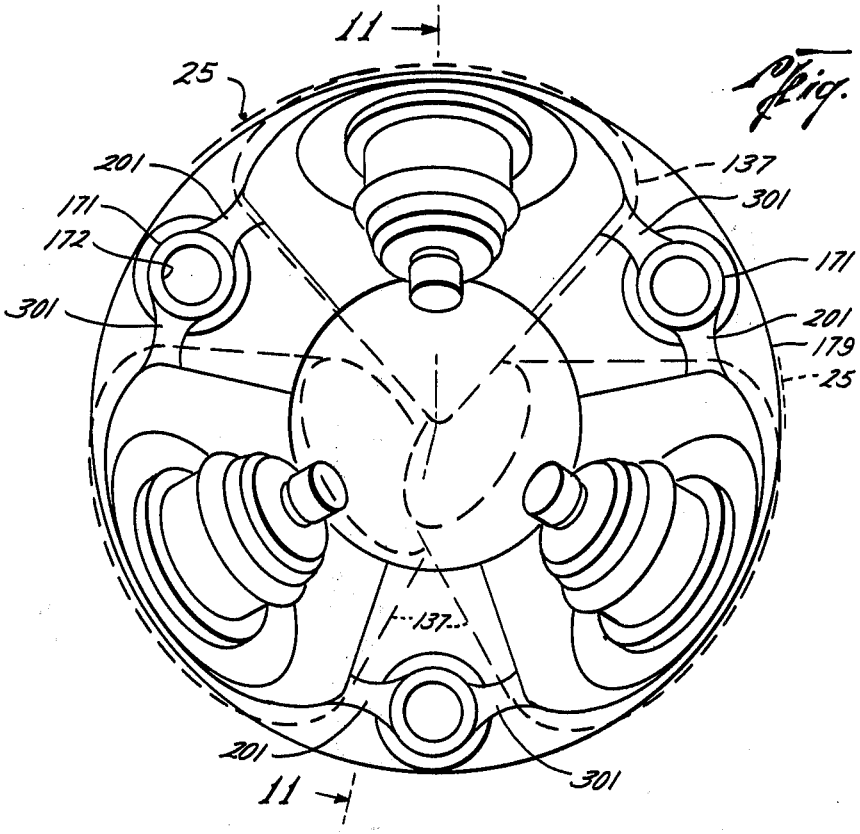
FIG. 12 is a bottom view of the bit shown in FIGS. 10 and 11.

Referring now to FIGS. 10, 11 and 12, there is shown a third embodiment of the bit. The only difference between the third embodiment and the second embodiment is in the addition of further webs, 301. Webs 301 provide additional detritus retention means, especially for retention of detritus kicked up by cones 137 (See FIG. 10).

With both webs 201 and 301, there is provided means for full retention of detritus at the interior of the bit above the level of the bottoms of the jets.

Webs 301, like webs 201 are positioned radially inward of the full gage bore 25 defined by cones 137, and may extend vertically to a lesser or greater but preferably equal extent compared to the lower ends of nozzles 171.

(i) Dual Conduit Bit—Fourth Embodiment

Figure 13:
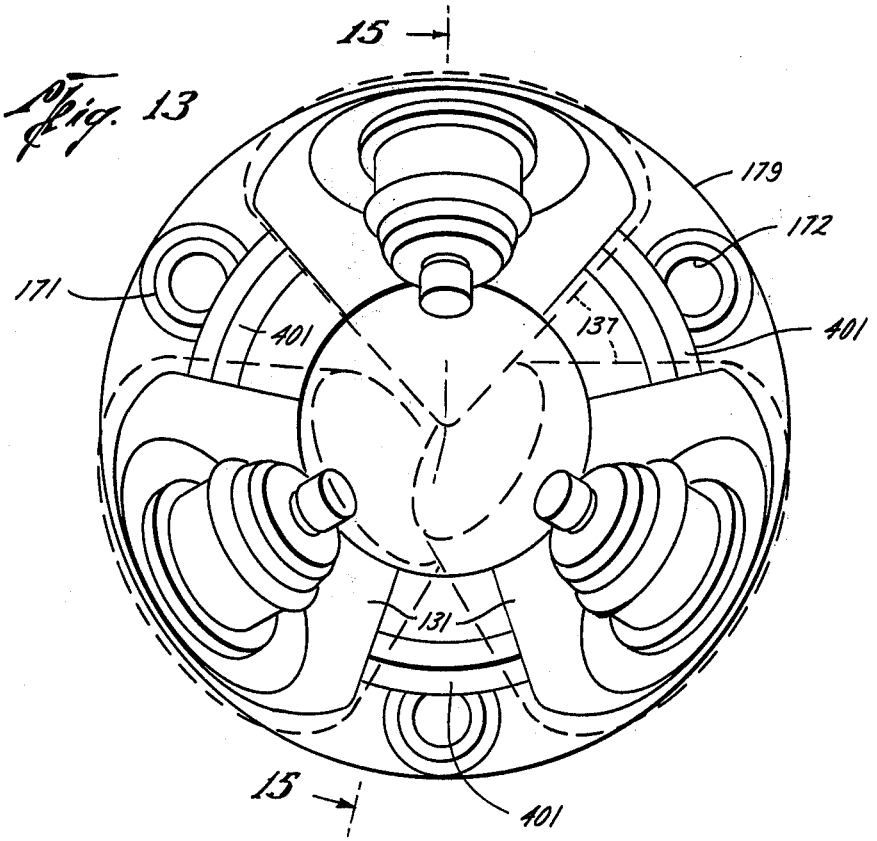
FIG. 13 is a bottom view of a further modified form of the bit, embodying interior braces.
Figure 14:
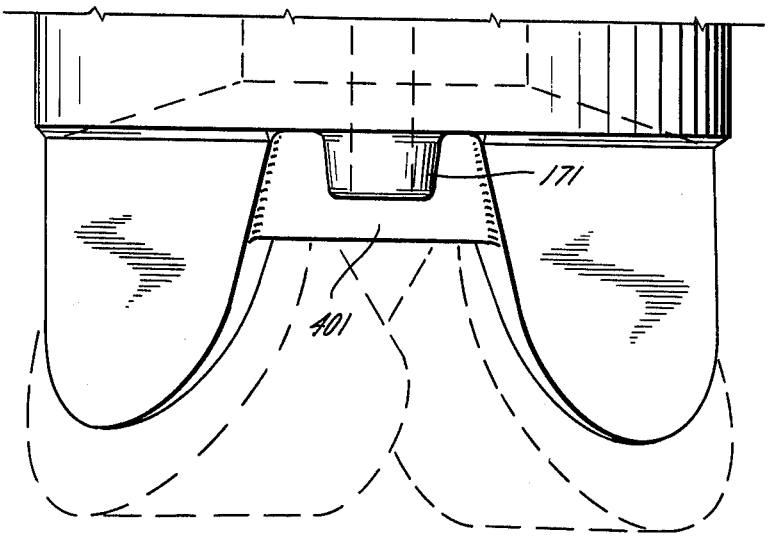
FIG. 14 is a fragmentary elevation of the bit shown in FIG. 13.
Figure 15:
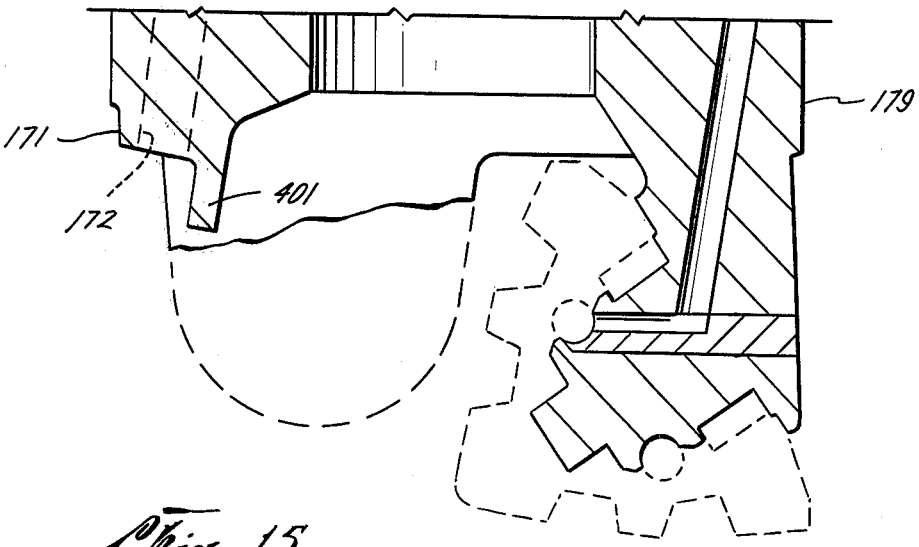
FIG. 15 is a fragmentary vertical section through the bit shown in FIG. 13, taken on plane 15—15 thereof.

Referring now to FIGS. 13–15, there is shown a fourth embodiment of the bit. In this embodiment, as in the first embodiment, there are no webs between the nozzles and legs. This embodiment is the same as the first embodiment except for the provision of webs 401 directly between legs 131. Also, nozzles 171 are set at an angle to the vertical. To this extent the construction is similar to that of shrouded (inside skirted) bits used with skirted (outside skirted) bit subs as previously described. However, the webs between the legs serve in this case not only as flow directing inside skirts but as detritus retention means. Note that in this case, however, such detritus retention means is radially inward of nozzles 171 (see FIG. 15).

While several preferred embodiments of the invention have been shown and described, many modifications thereof can be made by one skilled in the art without departing from the spirit of the invention. For example, although the nozzles are shown as being centered between the bit legs, they could be offcenter, either close to or farther from the cone leading the respective nozzle as the bit rotates. Also, one or more nozzles and cones could be omitted, e.g. as in the type BHDJ two cutter (two cone) bit illustrated in:

The Composite Catalog of Oil Field Equipment and Services; 32nd Revision, 1976–1977; page 5152 or additional cones or nozzles could be employed. The cutter cones themselves and also the nozzles do not necessarily have to be symmetrically positioned or equally spaced apart. Although the disclosed belted jet dual bit is disclosed in conjunction with a dual sub, it could be connected to the lower end of a dual collar, dual drill pipe, dual stabilizer or other dual drill stem member, with either dual box or pin and box ends, or in the case of a bit having a box instead of a pin, the connected dual drill string member could have box and pin ends or be a dual pin member. Although cutter cones having carbide inserts are disclosed, milled teeth or other forms of reducing means could be employed. Also other forms of rolling cutters could be employed, and the nozzles could be omitted.

I claim:

1. Dual flow passage jet bit comprising an annular body providing a central flow passage, a tubular pin coaxial with said body and rising therefrom and connected thereto, said pin being externally threaded, said pin having a smaller outer diameter than said body forming an annular upwardly facing shoulder at the juncture of said pin and body, a plurality of legs connected to and extending down from said body and symmetrically spaced therearound, the envelope of said legs having a smaller diameter than that of said body, the portion of said body extending radially outwardly beyond said legs providing a seal belt, a generally radially inwardly pointing cone rotatably mounted on the inwardly facing side of each leg, each cone having earth formation reducing means on its outer periphery, the axis of each cone pointing inwardly downwardly whereby the bottom edges of the cones as the cones roll in the bottom of a well bore define a surface that is nearly flat, being in a range between conical pointing up and conical pointing down, at least one of said cones having a portion carrying earth formation reducing means extending radially outwardly beyond said seal belt a distance sufficient to provide a rotating clearance between the seal belt end and an earth bore drilled with said bit, a plurality of off-axial passages extending from said shoulder downwardly through said annular body, and a nozzle connected to the lower end of each passage, each said nozzle being disposed in between said legs to carry fluid in between said cones and direct it to said bottom, said nozzles lying radially outside the cylindrical volume defined by a downward continuation of said central passage.

2. Drill bit according to claim 1 including baffle means extending down from said body adjacent each nozzle to retain detritus beneath said level until it is carried up said central flow passage.

3. Drill bit according to claim 2 wherein each said baffle means comprises a web extending from the nozzle to the bit leg trailing the nozzle.

4. Drill bit according to claim 3 wherein each said baffle means further comprises a web extending from the nozzle to the bit leg leading the nozzle.

5. Drill bit according to claim 2 wherein each said baffle means comprises a web extending between the legs adjacent said nozzle, each said web being disposed radially inward of the nozzle.

6. Drill bit according to any of claims 1 through 5 including a dual flow passage sub having a box screwed to said pin, said sub having an axial flow passage extending upwardly from said pin and off axial flow passage means radially outwardly of said axial flow passage communicating with the upper ends of said off-axial flow passages in said annular body, said sub having an outer diameter smaller than that of said belt.

7. Drill bit according to any of claims 1 through 5, said nozzles opening in a plane in the mid three-fifths of the distance between a transverse plane through the uppermost portions of the cones and a transverse plane through the lowermost portions of the cones.

* * * * *

UNITED STATES PATENT AND TRADEMARK OFFICE

CERTIFICATE OF CORRECTION

PATENT NO. : 4,293,048

DATED : October 6, 1981

INVENTOR(S) : Joseph A. Kloesel, Jr.

It is certified that error appears in the above—identified patent and that said Letters Patent is hereby corrected as shown below:

Column 1, line 38: move "(i) Commercial Examples" to be even with left margin(items (a)-(j)).

Column 3, line 49: change "outer" to -other-.

Column 4, line 8: after "Elenburg" delete "ps", and change "where" to -Where-.

Column 11, line 21: change "shirts" to -skirts-.

Column 17, line 43: change "150-inch" to -1/8 inch-.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*